US008454070B2

(12) United States Patent
Bierfreund

(10) Patent No.: US 8,454,070 B2
(45) Date of Patent: Jun. 4, 2013

(54) GRIPPER FOR PULLING ARROWS

(75) Inventor: Karl-Heinz Bierfreund, Ober-Ramstadt (DE)

(73) Assignee: Karl-Heinz Bierfreund (DE)

( * ) Notice: Subject to any disclaimer, the term of this patent is extended or adjusted under 35 U.S.C. 154(b) by 0 days.

(21) Appl. No.: 13/456,783

(22) Filed: Apr. 26, 2012

(65) Prior Publication Data

US 2012/0292935 A1 Nov. 22, 2012

(30) Foreign Application Priority Data

May 17, 2011 (DE) ..... 10 2011 101 796

(51) Int. Cl.
*B66F 15/00* (2006.01)

(52) U.S. Cl.
USPC ..... 294/217; 294/118; 294/902; 254/131

(58) Field of Classification Search
USPC ..... 294/217, 118, 902, 17; 254/22, 23, 254/120, 131
See application file for complete search history.

(56) References Cited

U.S. PATENT DOCUMENTS

| | | | | |
|---|---|---|---|---|
| 523,181 | A * | 7/1894 | Shattuck | 254/23 |
| 2,245,838 | A * | 6/1941 | Hall | 254/22 |
| 3,263,535 | A * | 8/1966 | Zurcher | 81/302 |
| 3,441,251 | A * | 4/1969 | Burns | 254/131 |
| 4,798,366 | A * | 1/1989 | Pearson et al. | 254/22 |
| 5,991,997 | A * | 11/1999 | Schley et al. | 29/426.5 |
| 6,854,776 | B2 * | 2/2005 | Downing | 294/215 |
| 7,682,270 | B2 * | 3/2010 | De Buyer-Mimeure | 473/578 |
| 2003/0074776 | A1 | 4/2003 | Miles | |

* cited by examiner

*Primary Examiner* — Dean Kramer
(74) *Attorney, Agent, or Firm* — Kaplan Breyer Schwarz & Ottesen, LLP

(57) ABSTRACT

A gripper for pulling arrows, wherein the gripper comprises a handle, a gripper head and three hinges. The handle and gripper head comprising two first legs extending in an elongated manner, which are connected to one another via the first hinge, which has a first rotation axis aligned transversely to the elongated extension of the legs, so that two counteracting levers are provided via a first hinge as a first support, wherein two lever arm sections act as force arm sections and arranged on the handle and two lever arm sections act as load arm sections and consequently are arranged on the gripper head, and wherein on each of the two lever arm sections that are arranged on the gripper head, a gripper jaw is pivoted in the interior of the gripper head via a second hinge.

8 Claims, 3 Drawing Sheets

GRIPPER FOR PULLING ARROWS

CROSS-REFERENCE TO RELATED APPLICATIONS

German patent application DE 10 2011 101 796.1, filed May 17, 2011, is incorporated herein by reference.

FIELD OF THE INVENTION

The invention relates to gripper for drawing arrows, which are composed essentially of an arrow head and an arrow shaft, wherein the arrow shaft has on the end lying opposite the arrow head a fletching for stabilizing the arrow during the flight.

BACKGROUND OF THE INVENTION

Arrows that are shot from bows or crossbows are composed of arrow heads and arrow shafts, which in turn are embodied with a fletching on the ends distant from the arrow heads. Traditionally, an arrow shaft of this type is hollow at least in part and the arrow head is inserted into the arrow shaft, e.g., in an arrow shaft of aluminum, carbon, a combination of the two or of wood. Due to the usually thin wall of the arrow shaft, furthermore a sleeve-like insert, hereinafter also referred to as insert, is generally arranged for receiving the arrow head in the interior of the arrow shaft. This insert is furthermore generally permanently embedded, e.g., adhered, wherein the arrow head frequently can also be inserted into the insert in a replaceable manner, e.g., by screwing the arrow head into the insert. The arrow can also be entirely of wood and provided with a fletching on the end of the arrow shaft distant from the arrow head.

As is known, when an arrow of this type is shot, from a bow or a crossbow, the speed thereof is very high, so that a large momentum develops even with small arrow masses. If the arrow strikes an object, e.g., a tree or a 3D target, and penetrates therein, the arrow head often plunges so deeply into the object hit that pulling out the arrow without damage to the same is possible, if at all, only with great effort. If grippers or also other arrow pulling aids known according to the prior art are used for this purpose, the action of force direction for pulling out the arrow must correspond essentially exactly to the longitudinal axis of the arrow in order to avoid bending and as a result lasting damage to the arrow.

SUMMARY OF THE INVENTION

The object of the invention is to disclose a gripper for pulling arrows, with which the pulling of arrows is considerably facilitated.

According to the invention, a gripper of this type for pulling arrows that are composed essentially of an arrow head and an arrow shaft, wherein the arrow shaft has on the end lying opposite the arrow head a fletching for stabilizing the arrow during flight, thus comprises a handle, a gripper head and at least three hinges. The gripper is furthermore characterized in that the handle and the gripper head comprise two first legs extending in an elongated manner, which are connected to one another via the first hinge, which has a first rotation axis aligned transversely to the elongated extension of the legs, so that two counteracting levers are provided by means of the first hinge as a first support. Two lever arm sections act as force arm sections and consequently are assigned to the handle and two lever arm sections act as load arm sections and consequently are assigned to the gripper head. The invention is further characterized in that on each of the two lever arm sections that are assigned to the gripper head, a gripper jaw is pivoted in the interior of the gripper head, namely respectively by means of a second hinge, which has a second rotation axis transverse to the elongated extension of the legs and transverse to the first rotation axis of the first hinge.

A major advantage hereby is that with the gripper-like, at least partial grasping of an arrow shaft by means of the gripper jaws, the fletching of the arrow shaft does not impede the use of the gripper according to the invention, nor does damage have to be risked to the fletching of the arrow shaft due to the use of the gripper. With the gripper according to the invention an application of the gripper starting from the end of the arrow shaft, i.e., fitting the gripper over the arrow shaft end and subsequently moving the gripper in the direction of the arrow head is no longer necessary. Another considerable advantage is that due to the two second hinges, which comprise a rotation axis transverse to the essentially longitudinally oriented alignment of the legs, movements pivoting about this rotation axis during the pulling process no longer cause a bending of the arrow.

According to a further preferred embodiment, the two second hinges furthermore can be embodied as universal joints, so that pivot movements while pulling out an arrow cannot cause a bending of the arrow about the longitudinal axis of the shaft extending in an elongated manner or about the transverse axis of the legs extending in an elongated manner.

Preferably, the gripper head furthermore merges in the region of the end facing away from the handle into an abutment surface, the active area of which in turn provides a support for a further lever comprising the gripper head and the handle and acting transversely to the levers acting opposite to one another.

In particular when the gripper according to the invention is embodied such that the two levers acting opposite one another are embodied as two second-class levers, and thus the first hinge is arranged essentially at one gripper end, this gripper end can already be used per se as an abutment surface.

In particular when the gripper is embodied according to an alternative embodiment such that the two first levers acting opposite one another are two first-class levers so that therefore the first hinge is essentially arranged between the handle and the gripper head, the gripper head is expediently embodied in an extended manner in the region of the end facing away from the handle, in order to merge into the abutment surface in this region of the end facing away from the handle.

As a result of the further lever comprising the gripper head and the handle and acting transversely to the two levers acting opposite one another, in addition to a tensile force essentially opposite to the alignment of the arrow, at the same time pressure can hereby be exerted on the object hit via the handle by means of the abutment surface so that pulling out an arrow is further facilitated due to the lever provided hereby.

According to advantageous embodiments it is furthermore provided that each of the gripper jaws in the interior of the gripper head has a groove-like shape, namely with a longitudinal extension that extends transversely to the second rotation axis and with a cross section that defines a circle arc, the center angle of which is no more than 180 degrees, wherein the interior surfaces of the groove-like shapes are directed towards one another.

According to another preferred further development the circle arc is defined by a radius that renders possible the gripper-like, at least partial positive grasping of an arrow shaft of a predetermined diameter or diameter range.

Expediently, it is further provided that the inner surfaces of the groove-like shapes are formed by a protective layer, in particular by a protective layer of rubber or a plastic.

BRIEF DESCRIPTION OF THE DRAWINGS

Further advantages and features of the invention are shown by the following description of preferred embodiments based on the attached drawings, which show.

DETAILED DESCRIPTION

Figure 1:
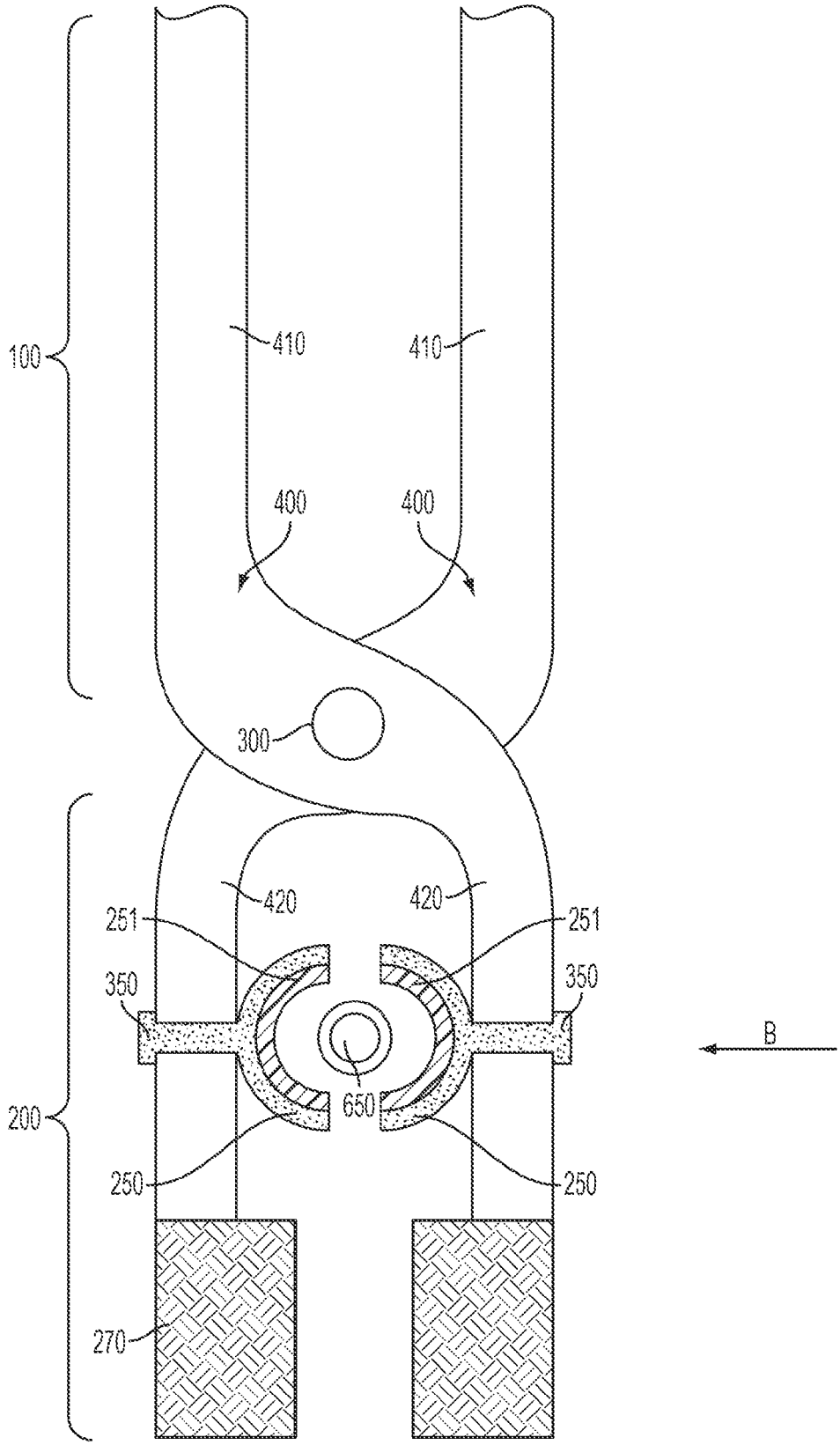
FIG. 1 a very simplified, sketched and partially sectional view of a first embodiment of a gripper for pulling arrows according to the invention, FIG. 2 a very simplified, sketched and partially sectional view in the direction of the viewing direction "B" of the gripper head of the embodiment according to FIG. 1, and FIG. 3 a very simplified, sketched and partially sectional view of an alternative embodiment of a gripper for pulling arrows according to the invention.

FIG. 1 is referred to first below, which in a very simplified, partially sectional sketched not to scale shows a first embodiment of a gripper for pulling arrows according to the invention.

Figure 2:
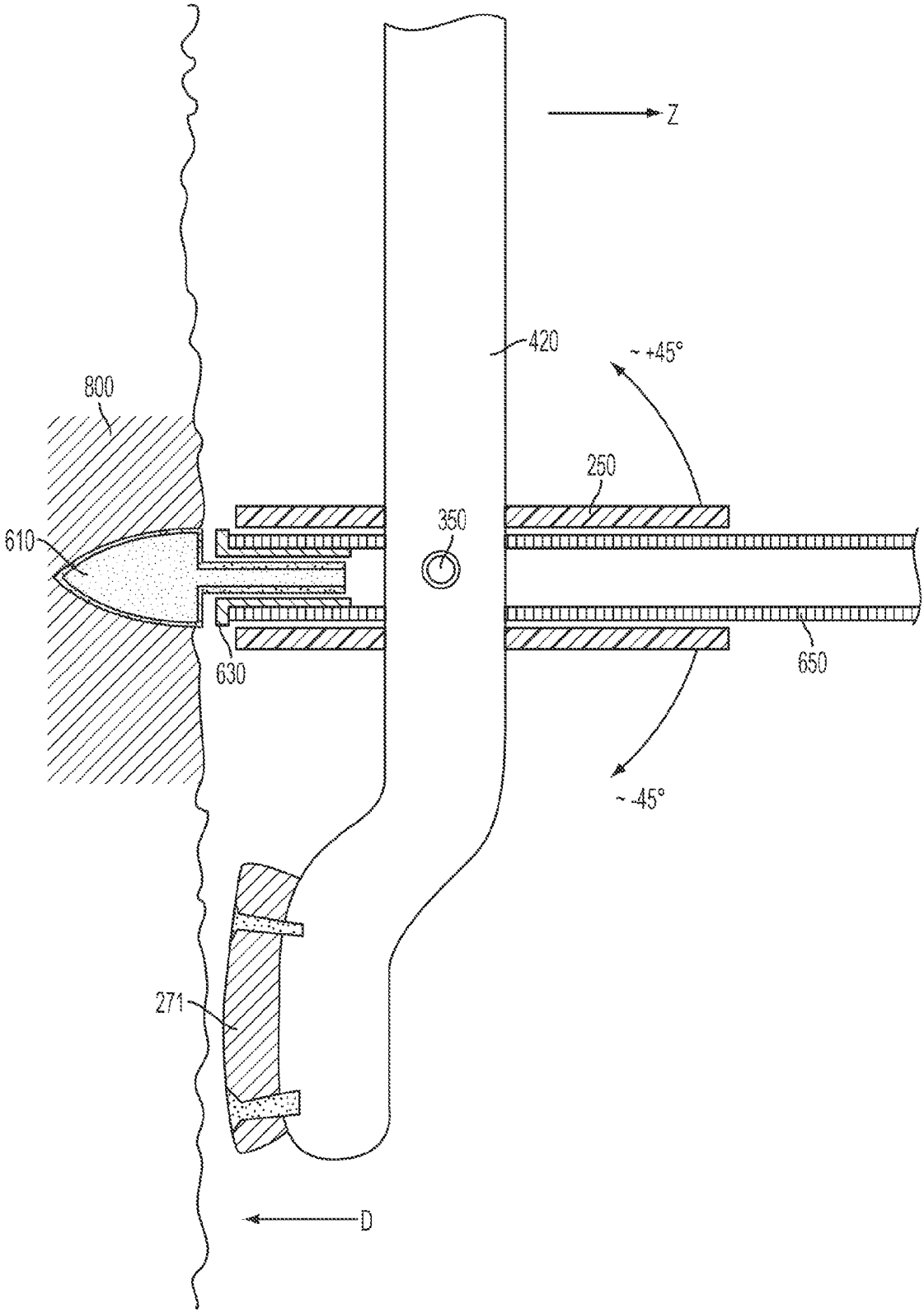
Figure 3:
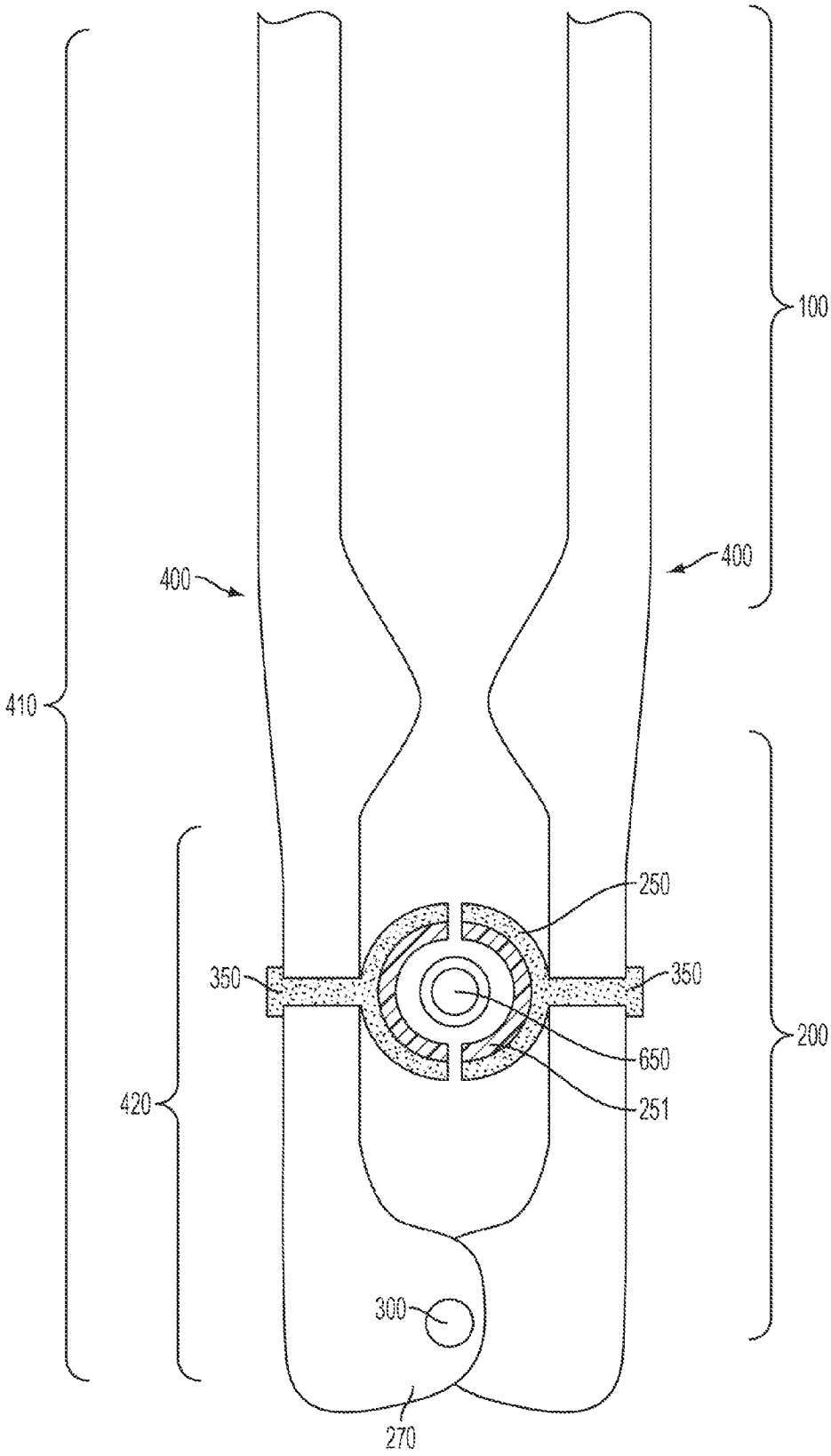

The gripper for pulling arrows or arrow pulling gripper shown in FIGS. 1 and 2 as well as in FIG. 3 is suitable in particular for arrows that are composed essentially of an arrow head 610 and an arrow shaft 650, wherein the arrow shaft at the end lying opposite the arrow head has a fletching, not shown in the figures, for stabilizing the arrow during flight. Due to the usually thin wall of the arrow shaft 650, furthermore a sleeve-like insert 630 to receive the arrow head 610 is generally arranged in the interior of the arrow shaft.

The gripper according to FIGS. 1 and 2, wherein FIG. 2 is a very simplified, sketched and partially sectional view in the direction of the viewing direction "B" of the gripper head of the embodiment according to FIG. 1, has a handle 100, a gripper head 200 and at least three hinges 300, 350, wherein the handle 100 and the gripper head 200 comprise two first legs 400 extending in an elongated manner, i.e., legs 400 extending along the handle 100 and gripper head 200, which are connected to one another via the first hinge 300, which has a first rotation axis aligned transversely to the longitudinal extension of the legs 400. As can be seen in the figures, the gripper head 200 thus basically has an end facing towards the handle 100 and an end facing away from the handle 100.

Thus two counteracting levers are provided by means of this first hinge 300, wherein the hinge 300 acts as first support for both levers and two lever arm sections 410 act as force arm sections and thus are assigned to the handle 100 and two lever arm sections 420 act as load arm sections and thus are assigned to the gripper head 200.

Furthermore, in the embodiment shown according to FIGS. 1 and 2, the first hinge 300 is arranged between the handle 100 and the gripper head 200, so that the two counteracting levers are two first-class levers. Since in the embodiment shown the two legs 400 extending in an elongated manner furthermore intersect, and the first hinge 300 is arranged in the intersection region, the lever action is such that with counteracting force exertion on the force arm sections 410 for the pivoting thereof about the first rotation axis a force oriented in a corresponding manner is produced on the load arm sections 420. In other words, depending on whether a force directed "inwards" or "outwards" is exerted on the force arm sections 410, a force directed "inwards" or "outwards" is also produced on the load arm sections 420.

However, it should be noted that basically an intersection of the two legs extending in an elongated manner is not necessary with the provision of two first-class levers. Thus in a modification, not shown, of FIG. 1, e.g., the first hinge can be arranged between the handle and the gripper head, instead of an intersection region, however, only an overlapping region can be provided in which the first hinge is arranged and each leg thus otherwise along the handle and the gripper head is always located on the same side with reference to the first hinge. In a case of this type the lever action is then such that with counteracting exertion of force on the force arm sections for the pivoting thereof about the first rotation axis, force opposite this exertion of force is produced on the load arm sections. In other words, depending on whether a force directed "inwards" or "outwards" is exerted on the force arm sections 410, a force directed "outwards" or "inwards" is also produced on the load arm sections 420.

On each of the two lever arm sections 420, which are assigned to the gripper head 200, a gripper jaw 250 is pivoted in the interior of the gripper head, and respectively namely by means of a second hinge 350. These two second hinges 350 respectively have a second rotation axis transverse to the elongated extension of the legs 400 and transverse to the first rotation axis of the first hinge 300.

If the arrow strikes an object 800, e.g., a tree or a 3D target, and penetrates therein, the arrow head 610 consequently plunges deeply into the hit object. For a pulling out of the arrow by means of a gripper according to the invention, thus with the gripper-like at least partial grasping of the arrow shaft 650 by means of the gripper jaws 250, the fletching of the arrow shaft does not impede the use of the gripper, nor must damage be risked to the fletching of the arrow shaft by the use of the gripper, since with the gripper according to the invention an application of the gripper starting from the end of the arrow shaft, i.e., fitting over the gripper on the arrow shaft end and subsequent movement of the gripper in the direction of the arrow head, is no longer necessary. Also due to the two second hinges 350, pivoting movements about their identical rotation axes during the pulling process no longer causes a bending of the arrow. By way of example, a movement angle of these possible pivoting movements about the rotation axes of the two second hinges 350 of +/−45° about the longitudinal axis of the arrow shaft 650 is shown in FIG. 2, wherein, depending on the specific gripper embodiment, larger angles can also be possible.

Expediently, each of the gripper jaws 250 has a groove-like or dish-like shape with a longitudinal extension that extends transversely to the rotation axis of the two second hinges 350 and with a cross section that defines a circle arc, the center angle of which is no more than 180°, wherein the inner surfaces of the groove-like shapes are aligned towards one another. Each cross section of the groove-like or dish-like shapes of the gripper jaws 250 expediently corresponds along the longitudinal extension of the gripper jaw 250 essentially to the cross section of a hollow semicylinder. The circle arc is consequently expediently defined by a radius that renders possible at least in part grasping an arrow shaft 650 of a predetermined cross section or cross section range. The inner surfaces 251 of the groove-like shapes are furthermore preferably formed by a protective layer, in particular of rubber or a plastic, for the protection of the arrow shaft from damage.

Expediently, the gripper head 200 furthermore merges in the region of the end facing away from the handle 100 into an abutment surface 270, the active area of which provides a support for a further lever comprising the gripper head 200 and the handle 100 and acting transversely to the two counteracting levers, as a result of such a further lever, comprising the gripper head 200 and the handle 100 and acting transversely to the two levers acting opposite one another, via the handle in addition to a tensile force "Z" (FIG. 2) directed essentially opposite to the alignment of the arrow, at the same time pressure "D" (FIG. 2) can be exerted on the hit object 800 by means of the abutment surface, so that due to the further lever provided hereby, pulling out an arrow is further facilitated. As can be seen in FIGS. 1 and 2, the gripper head 200 for this purpose can be embodied in an elongated manner in the region of the end facing away from the handle and/or provided with an additional pressure support, in particular a pressure support 271 protecting the hit object 800.

FIG. 3 shows in a very simplified, sketched and partially sectional view an alternative embodiment to the embodiment according to FIGS. 1 and 2 of a gripper for pulling arrows according to the invention.

This gripper also has a handle 100, a gripper head 200 and at least three hinges 300, 350, wherein the handle 100 and the gripper head 200 comprise two first legs 400 extending in an elongated manner, which are connected to one another via the first hinge 300, which has a first rotation axis aligned transversely to the elongated extension of the legs 400; and the gripper head 200 thus has basically an end facing towards the handle 100 and an end facing away from the handle 100.

Thus in turn two counteracting levers are provided by means of this first hinge 300, wherein the hinge 300 acts as a first support for the two levers and two lever arm sections 410 act as force arm sections and thus are assigned to the handle 100 and two lever arm sections 420 act as load arm sections and thus are assigned to the gripper head 200.

In a modification of the embodiment according to FIGS. 1 and 2, in the embodiment shown according to FIG. 3, however, the first hinge 300 is arranged on the end of the gripper head 200 facing away from the handle 100, so that the two counteracting levers are two second-class levers. In this case, the load arm sections and the force arm sections thus coincide, wherein, however, the lever arm sections 410 acting as force arm sections are longer than the lever arm sections 420 acting as load arm sections. With opposite force action on the force arm sections 410 for the pivoting thereof about the first rotation axis, again a force directed in a corresponding manner is produced on the load arm sections 420, i.e., depending on whether a force directed "inwards" or "outwards" is exerted on the force arm sections 410, a force directed "inwards" or "outwards" is also produced on the load arm sections 420.

In turn, a gripper jaw 250 is pivoted in the interior of the gripper head by means of respectively one second hinge 350 on each of the two lever arm sections 420, which are assigned to the gripper head 200, wherein with reference to the embodiment of the gripper jaws 250 and the second hinges 350, reference can be made to the description with respect to FIGS. 1 and 2. Furthermore, in the region of the end facing away from the handle 100 the gripper head 200 also merges into an abutment surface 270, the active area of which provides a support for a further lever comprising the gripper head 200 and the handle 100 and acting transversely to the two counteracting levers, wherein in the embodiment according to FIG. 3, the gripper end on which the first hinge 300 is arranged can already be used per se as an abutment surface. Of course this end, however, can also additionally be elongated and/or provided with an additional pressure support.

Furthermore, embodiments not shown in the figures lie within the scope of the invention, in which, e.g., the two second hinges are embodied as universal joints so that pivot movements when pulling out an arrow about the longitudinal axis of the legs extending in an elongated manner or about the transverse axis of the legs extending in an elongated manner cannot cause a bending of the arrow and/or in which e.g., the handle of the gripper comprises holding sections aligned transversely to the force arm sections, in particular holding sections embodied ergonomically for improved manual holding and exertion of force.

What is claimed is:

1. A gripper for pulling arrows, which are composed essentially of an arrow head and an arrow shaft, wherein the arrow shaft has on the end lying opposite the arrow head a fletching for stabilizing the arrow during the flight, the gripper comprising:

a handle (100), a gripper head (200) and at least three hinges (300, 350), wherein the handle (100) and the gripper head (200) comprise two first legs (400) extending in an elongated manner, which are connected to one another via one of the three hinges defined as a first hinge (300), which has a first rotation axis aligned transversely to the elongated extension of the legs, so that two counteracting levers are provided by means of the first hinge as a first support, wherein two lever arm sections (410) act as force arm sections and consequently are arranged on the handle (100), and two lever arm sections (420) act as load arm sections and consequently are arranged on the gripper head (200), and wherein on each of the two lever arm sections (420) that are arranged on the gripper head, a gripper jaw (250) is pivoted in the interior of the gripper head (200), namely respectively by means of a second hinge (350), which has a second rotation axis transverse to the elongated extension of the legs and transverse to the first rotation axis of the first hinge, wherein each gripper law (250) has a groove-like shape with a longitudinal extension that extends substantially perpendicular to the extension of the legs (400) when the gripper is not operated, and wherein each lever arm section (420) extends from the position of the second hinge (350) carrying the gripper law (250) further in a direction of an end facing away from the handle (100), thereby defining a projection providing a further lever for pivotal movement of the gripper law (250) about the end of lever arm section (420) facing away from the handle (100).

2. The gripper according to claim 1, wherein each of the gripper jaws (250) has a groove-like shape, namely with a longitudinal extension that extends transversely to the rotation axis of the second hinge and a cross section that defines a circle arc, the center angle of which is no more than 180°, wherein the interior surfaces of the groove-like shapes are directed towards one another.

3. The gripper according to claim 2, wherein the circle arc is defined by a radius that renders possible the gripper-like, at least partial positive grasping of an arrow shaft of a predetermined diameter or diameter range.

4. The gripper according to claim 2, wherein the inner surface of the groove-like shape is formed by a protective layer (251).

5. The gripper according to claim 4, wherein the protective layer is of rubber.

6. The gripper according to claim 4, wherein the protective layer is of a plastic.

7. The gripper according to claim 1, wherein the gripper head has an end facing towards the handle and an end facing away from the handle, wherein the gripper head merges in the region of the end facing away from the handle into an abutment surface (270), the active area of which provides a support for a further lever comprising the gripper head and the handle and acting transversely to the two counteracting levers.

8. The gripper according to claim 1, wherein the two counteracting levers are two second-class levers or that the two counteracting levers are two first-class levers.

* * * * *